US010339864B2

(12) United States Patent
Song et al.

(10) Patent No.: US 10,339,864 B2
(45) Date of Patent: Jul. 2, 2019

(54) FRAME STRUCTURE OF IMAGE DATA AND METHOD OF DIGITAL-DRIVING AN ORGANIC LIGHT EMITTING DISPLAY DEVICE USING THE SAME

(71) Applicant: Samsung Display Co., LTD., Yongin-si, Gyeonggi-Do (KR)

(72) Inventors: Jae-Woo Song, Anyang-si (KR); Hae-Goo Jung, Seongnam-si (KR); Seung-Ho Park, Suwon-si (KR); Jae-Hoon Lee, Seoul (KR); Mi-Young Joo, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 274 days.

(21) Appl. No.: 15/004,905

(22) Filed: Jan. 23, 2016

(65) Prior Publication Data

US 2016/0365033 A1 Dec. 15, 2016

(30) Foreign Application Priority Data

Jun. 11, 2015 (KR) ..... 10-2015-0082349

(51) Int. Cl.
*G09G 3/20* (2006.01)
*G09G 3/3258* (2016.01)

(52) U.S. Cl.
CPC ..... *G09G 3/3258* (2013.01); *G09G 3/2022* (2013.01); *G09G 3/2003* (2013.01); *G09G 2300/0842* (2013.01); *G09G 2330/021* (2013.01); *G09G 2330/025* (2013.01); *G09G 2360/16* (2013.01)

(58) Field of Classification Search
CPC ... G09G 3/2022; G09G 3/2025; G09G 3/3258
See application file for complete search history.

(56) References Cited

U.S. PATENT DOCUMENTS

| | | | | |
|---|---|---|---|---|
| 8,373,625 | B2 | 2/2013 | Kimura | |
| 8,633,919 | B2 * | 1/2014 | Kimura | G09G 3/32 345/204 |
| 2003/0006952 | A1 * | 1/2003 | Hong | G09G 3/3648 345/89 |
| 2005/0088370 | A1 * | 4/2005 | Shigeta | G09G 3/2022 345/60 |

FOREIGN PATENT DOCUMENTS

| | | | |
|---|---|---|---|
| KR | 1020090054320 | A | 5/2009 |
| KR | 1020140133189 | A | 11/2014 |

* cited by examiner

*Primary Examiner* — Amr A Awad
*Assistant Examiner* — Stephen A Bray
(74) *Attorney, Agent, or Firm* — Cantor Colburn LLP

(57) ABSTRACT

A method of digital-driving an organic light emitting display device includes analyzing a light emission pattern of the input image data and converting a third grayscale of the input image data into a first converted grayscale and a second converted grayscale based on an analysis result of the light emission pattern of the input image data.

15 Claims, 14 Drawing Sheets

510

| GREY | SF1 | SF2 | SF3 | SF4 | SF5 | SF6 | SF7 | SF8 | SUM |
|---|---|---|---|---|---|---|---|---|---|
| WEIGHT | 1 | 2 | 4 | 8 | 16 | 32 | 64 | 128 | 255 |
| 7 | 1 | 1 | 1 | 0 | 0 | 0 | 0 | 0 | 7 |
| 30 | 0 | 1 | 1 | 1 | 1 | 0 | 0 | 0 | 30 |
| 90 | 0 | 1 | 0 | 1 | 1 | 0 | 1 | 0 | 90 |
| 127 | 1 | 1 | 1 | 1 | 1 | 1 | 1 | 0 | 127 |
| 135 | 1 | 1 | 1 | 0 | 0 | 0 | 0 | 1 | 135 |
| 159 | 0 | 1 | 1 | 1 | 1 | 0 | 0 | 1 | 159 |
| 219 | 0 | 1 | 0 | 1 | 1 | 0 | 1 | 1 | 219 |
| 255 | 1 | 1 | 1 | 1 | 1 | 1 | 1 | 1 | 255 |

FIG. 5B

520

521 522

526

527

| GREY | SF1 | SF2 | SF3 | SF4 | SF5 | SF6 | SF7 | SF8 | SF9 | SF10 | SF11 | SF12 | SF13 | SF14 | SUM |
|---|---|---|---|---|---|---|---|---|---|---|---|---|---|---|---|
| WEIGHT | 64 | 32 | 16 | 8 | 4 | 2 | 1 | 1 | 2 | 4 | 8 | 16 | 32 | 64 | 254 |
| 7 | 0 | 0 | 0 | 0 | 0 | 0 | 0 | 1 | 1 | 1 | 0 | 0 | 0 | 0 | 7 |
| 30 | 0 | 0 | 0 | 0 | 0 | 0 | 0 | 0 | 1 | 1 | 1 | 1 | 0 | 0 | 30 |
| 90 | 0 | 0 | 0 | 0 | 0 | 0 | 0 | 0 | 1 | 0 | 1 | 1 | 0 | 1 | 90 |
| 127 | 0 | 0 | 0 | 0 | 0 | 0 | 0 | 1 | 1 | 1 | 1 | 1 | 1 | 1 | 127 |
| 135 | 0 | 0 | 0 | 0 | 1 | 1 | 1 | 0 | 0 | 0 | 0 | 0 | 0 | 0 | 7 |
| 158 | 0 | 0 | 1 | 1 | 1 | 1 | 0 | 0 | 0 | 0 | 0 | 0 | 0 | 0 | 30 |
| 218 | 1 | 0 | 1 | 1 | 0 | 1 | 0 | 0 | 0 | 0 | 0 | 0 | 0 | 0 | 90 |
| 255 | 1 | 1 | 1 | 1 | 1 | 1 | 1 | 0 | 0 | 0 | 0 | 0 | 0 | 0 | 127 |

FIG. 5C

530

521 522

526

527

| GREY | SF1 | SF2 | SF3 | SF4 | SF5 | SF6 | SF7 | SF8 | SF9 | SF10 | SUM |
|---|---|---|---|---|---|---|---|---|---|---|---|
| WEIGHT | 64 | 32 | 16 | 1 | 2 | 4 | 8 | 16 | 32 | 64 | 239 |
| 7 | 0 | 0 | 0 | 1 | 1 | 1 | 0 | 0 | 0 | 0 | 7 |
| 30 | 0 | 0 | 0 | 0 | 1 | 1 | 1 | 1 | 0 | 0 | 30 |
| 64 | 0 | 0 | 0 | 0 | 0 | 0 | 0 | 0 | 0 | 1 | 64 |
| 90 | 0 | 0 | 0 | 0 | 1 | 0 | 1 | 1 | 0 | 1 | 90 |
| 127 | 0 | 0 | 0 | 1 | 1 | 1 | 1 | 1 | 1 | 1 | 127 |
| 135 | 0 | 0 | 0 | 1 | 1 | 1 | 0 | 0 | 0 | 0 | 7 |
| 158 | 0 | 0 | 1 | 0 | 1 | 1 | 1 | 0 | 0 | 0 | 30 |
| 192 | 1 | 0 | 0 | 0 | 0 | 0 | 0 | 0 | 0 | 0 | 64 |
| 218 | 1 | 0 | 1 | 0 | 1 | 0 | 1 | 0 | 0 | 0 | 90 |
| 255 | 1 | 1 | 1 | 1 | 1 | 1 | 1 | 0 | 0 | 0 | 127 |

FIG. 5D

540

521 522

| | GREY | SF1 | SF2 | SF3 | SF4 | SF5 | SF6 | SF7 | SF8 | SF9 | SF10 | SF11 | SF12 | SF13 | SF14 | SUM |
|---|---|---|---|---|---|---|---|---|---|---|---|---|---|---|---|---|
| | WEIGHT | 1 | 2 | 4 | 8 | 16 | 32 | 64 | 1 | 2 | 4 | 8 | 16 | 32 | 64 | 254 |
| 526 | 7 | 0 | 0 | 0 | 0 | 0 | 0 | 0 | 1 | 1 | 1 | 0 | 0 | 0 | 0 | 7 |
| | 30 | 0 | 0 | 0 | 0 | 0 | 0 | 0 | 0 | 1 | 1 | 1 | 1 | 0 | 0 | 30 |
| | 90 | 0 | 0 | 0 | 0 | 0 | 0 | 0 | 0 | 1 | 0 | 1 | 1 | 0 | 1 | 90 |
| | 127 | 0 | 0 | 0 | 0 | 0 | 0 | 0 | 1 | 1 | 1 | 1 | 1 | 1 | 1 | 127 |
| 527 | 135 | 1 | 1 | 1 | 0 | 0 | 0 | 0 | 0 | 0 | 0 | 0 | 0 | 0 | 0 | 7 |
| | 158 | 0 | 1 | 1 | 1 | 1 | 0 | 0 | 0 | 0 | 0 | 0 | 0 | 0 | 0 | 30 |
| | 218 | 0 | 1 | 0 | 1 | 1 | 0 | 1 | 0 | 0 | 0 | 0 | 0 | 0 | 0 | 90 |
| | 255 | 1 | 1 | 1 | 1 | 1 | 1 | 1 | 0 | 0 | 0 | 0 | 0 | 0 | 0 | 127 |

FIG. 5E

550

521

522

| GREY | SF1 | SF2 | SF3 | SF4 | SF5 | SF6 | SF7 | SF8 | SF9 | SF10 | SF11 | SF12 | SUM |
|---|---|---|---|---|---|---|---|---|---|---|---|---|---|
| WEIGHT | 1 | 2 | 4 | 8 | 16 | 32 | 64 | 4 | 8 | 16 | 32 | 64 | 251 |
| 7 | 1 | 1 | 1 | 0 | 0 | 0 | 0 | 0 | 0 | 0 | 0 | 0 | 7 |
| 30 | 0 | 1 | 1 | 1 | 1 | 0 | 0 | 0 | 0 | 0 | 0 | 0 | 30 |
| 90 | 0 | 1 | 0 | 1 | 1 | 0 | 1 | 0 | 0 | 0 | 0 | 0 | 90 |
| 127 | 1 | 1 | 1 | 1 | 1 | 1 | 1 | 0 | 0 | 0 | 0 | 0 | 127 |
| 135 | 1 | 1 | 0 | 0 | 0 | 0 | 0 | 1 | 0 | 0 | 0 | 0 | 7 |
| 158 | 0 | 1 | 0 | 0 | 0 | 0 | 0 | 1 | 1 | 1 | 0 | 0 | 30 |
| 218 | 0 | 1 | 0 | 0 | 0 | 0 | 0 | 0 | 1 | 1 | 0 | 1 | 90 |
| 255 | 1 | 1 | 0 | 0 | 0 | 0 | 0 | 1 | 1 | 1 | 1 | 1 | 127 |

526

527

FIG. 5F

560

521 522

526

527

| GREY | SF1 | SF2 | SF3 | SF4 | SF5 | SF6 | SF7 | SF8 | SF9 | SUM |
|---|---|---|---|---|---|---|---|---|---|---|
| WEIGHT | 128 | 1 | 2 | 4 | 8 | 16 | 32 | 64 | 128 | 383 |
| 7 | 0 | 1 | 1 | 1 | 0 | 0 | 0 | 0 | 0 | 7 |
| 30 | 0 | 0 | 1 | 1 | 1 | 1 | 0 | 0 | 0 | 30 |
| 90 | 0 | 0 | 1 | 0 | 1 | 1 | 0 | 1 | 0 | 90 |
| 127 | 0 | 1 | 1 | 1 | 1 | 1 | 1 | 1 | 0 | 127 |
| 135 | 0 | 1 | 1 | 1 | 0 | 0 | 0 | 0 | 1 | 135 |
| 158 | 0 | 0 | 1 | 1 | 1 | 1 | 0 | 0 | 1 | 158 |
| 218 | 0 | 0 | 1 | 0 | 1 | 1 | 0 | 1 | 1 | 218 |
| 255 | 0 | 1 | 1 | 1 | 1 | 1 | 1 | 1 | 1 | 255 |
| 263 | 1 | 1 | 1 | 1 | 0 | 0 | 0 | 0 | 0 | 135 |
| 286 | 1 | 0 | 1 | 1 | 1 | 1 | 0 | 0 | 0 | 158 |
| 346 | 1 | 0 | 1 | 0 | 1 | 1 | 0 | 1 | 0 | 218 |
| 383 | 1 | 1 | 1 | 1 | 1 | 1 | 1 | 1 | 0 | 255 |

FRAME STRUCTURE OF IMAGE DATA AND METHOD OF DIGITAL-DRIVING AN ORGANIC LIGHT EMITTING DISPLAY DEVICE USING THE SAME

This application claims priority to Korean Patent Application No. 10-2015-0082349, filed on Jun. 11, 2015, and all the benefits accruing therefrom under 35 U.S.C. § 119, the content of which in its entirety is herein incorporated by reference.

BACKGROUND

1. Field

Exemplary embodiments relate to a display device. More particularly, exemplary embodiments of the invention relate to a frame structure of image data and a method of digital-driving an OLED device using the frame structure.

2. Description of the Related Art

A digital-driving technique employed or used in an organic light emitting display ("OLED") device may display an image based on image data by dividing a frame of the image data into sub-frames. Generally, light emitting times or allocated times of the sub-frames are set to be different from each other having a ratio of $2^n$, where n is a positive integer. A certain grayscale may be represented based on a sum of the light emitting times.

SUMMARY

An organic light emitting display ("OLED") device may intensively emit light in a certain period in a frame when the OLED device displays grayscales that are the same as or similar to each other. That is, a light emission pattern of the OLED device is concentrated in the certain period. Therefore, driving consumption power may be rapidly increased in the certain period, and a current-resistance drop (IR drop) or an ohmic drop of a driving power voltage may be rapidly increased in the certain period. In addition, according to a difference between amounts of emission light of the pixels due to a rapid change of the driving power voltage, a color deviation between the pixels may occur.

Exemplary embodiments provide a frame structure of image data that can distribute a light emission pattern of the image data.

Exemplary embodiments provide a method of digital-driving an OLED device that can reduce a current-resistance drop of a power voltage and a color deviation due to a concentration of the light emission pattern of the image data.

According to exemplary embodiments, a method of digital-driving an OLED device that displays an image based on input image data by dividing a frame into sub-frames, the method may include analyzing a light emission pattern of the input image data for each frame, and converting a third grayscale of the input image data into a first converted grayscale and a second converted grayscale based on an analysis result of the light emission pattern of the input image data.

In exemplary embodiments, converting the third grayscale of the input image data may include converting the third grayscale of the input image data for a first pixel into the first converted grayscale that uses a first sub-frame, and converting the third grayscale of the input image data for a second pixel located adjacent to the first pixel into the second converted grayscale that uses a second sub-frame, where each of the first sub-frame and the second sub-frame may have a first time weight.

In exemplary embodiments, the frame may include a first sub-frame group and a second sub-frame group that are divided based on light emitting orders of the sub-frames, where the first sub-frame group includes the first sub-frame and the second sub-frame group includes the second sub-frame.

In exemplary embodiments, the first sub-frame may be spaced apart from the second sub-frame in the frame.

In exemplary embodiments, the first sub-frame may have a light emitting order opposite to a light emitting order of the second sub-frame.

In exemplary embodiments, the first time weight may be the largest among a plurality of time weights included in the frame.

In exemplary embodiments, converting the third grayscale of the first pixel into the first converted grayscale may include reducing the third grayscale by a predetermined ratio.

In exemplary embodiments, the method may further include increasing a driving power voltage supplied to the display panel in proportion to the predetermined ratio.

In exemplary embodiments, converting the third grayscale of the second pixel into the second converted grayscale may include generating the second converted grayscale by summing the first converted grayscale and a maximum value of the first converted grayscale.

In exemplary embodiments, the first pixel may be located in a pixel column that is different from a pixel column including the second pixel.

In exemplary embodiments, the first pixel may be located in a pixel row that is different from a pixel row including the second pixel.

In exemplary embodiments, analyzing the light emission pattern of the input image data may include analyzing a grayscale distribution of the input image data.

In exemplary embodiments, the third grayscale of the input image data may be converted into the first converted grayscale and the second converted grayscale when the grayscale distribution of the input image data is within a reference distribution.

In exemplary embodiments, the method may further include generating a data signal from the input image data based on the first converted grayscale and the second converted grayscale.

According to exemplary embodiments, a method of digital-driving an OLED device that displays an image based on input image data by dividing a frame into sub-frames, the method may include receiving the input image data, and converting a third grayscale of the input image data into a first converted grayscale and a second converted grayscale based on an analysis result of the light emission pattern of the input image data.

In exemplary embodiments, converting the third grayscale of the input image data may include converting the third grayscale of the input image data for a first pixel into the first converted grayscale that uses a first sub-frame, and converting the third grayscale of a second pixel located adjacent to the first pixel into the second converted grayscale that uses a second sub-frame, where each of the first sub-frame and the second sub-frame has a first time weight.

In exemplary embodiments, the first sub-frame may have a light emitting order opposite to a light emitting order of the second sub-frame.

According to exemplary embodiments, a frame structure of image data used in a digital-driving technique for an OLED device, the frame structure may include a first sub-frame having a first light emitting order and a first time weight, and a second sub-frame having the first time weight and a second light emitting order that is different from the first light emitting order. Here, the first sub-frame may be used to represent a first grayscale, the second sub-frame is used to represent a second grayscale, and the first grayscale and the second grayscale may correspond to a same luminance.

In exemplary embodiments, the frame structure may further include a third sub-frame having a third light emitting order and a third time weight, where the third sub-frame may be used to represent the first grayscale and the second grayscale.

In exemplary embodiments, the second light emitting order may be opposite to the first light emitting order in a frame of the image data.

Therefore, a frame structure of image data according to exemplary embodiments may distribute a light emission pattern of the image data by including sub-frames that have the same time weight, have a different light emitting order, and are respectively used to represent grayscales that represent the same luminance.

A method of digital-driving an OLED device according to exemplary embodiments may distribute a light emission pattern of image data by generating grayscales that correspond to the same luminance but use a different sub-frame. Therefore, the method of digital-driving the OLED device may reduce a current-resistance drop of a driving power voltage and a color deviation due to a concentration of the light emission pattern.

BRIEF DESCRIPTION OF THE DRAWINGS

Illustrative, non-limiting exemplary embodiments will be more clearly understood from the following detailed description taken in conjunction with the accompanying drawings.

FIG. 4 is a block diagram illustrating an example of a timing controller included in the OLED device of FIG. 1.

FIGS. 5A to 5F are diagrams illustrating examples of LUTs used in the timing controller of FIG. 4.

DESCRIPTION

Figure 1:
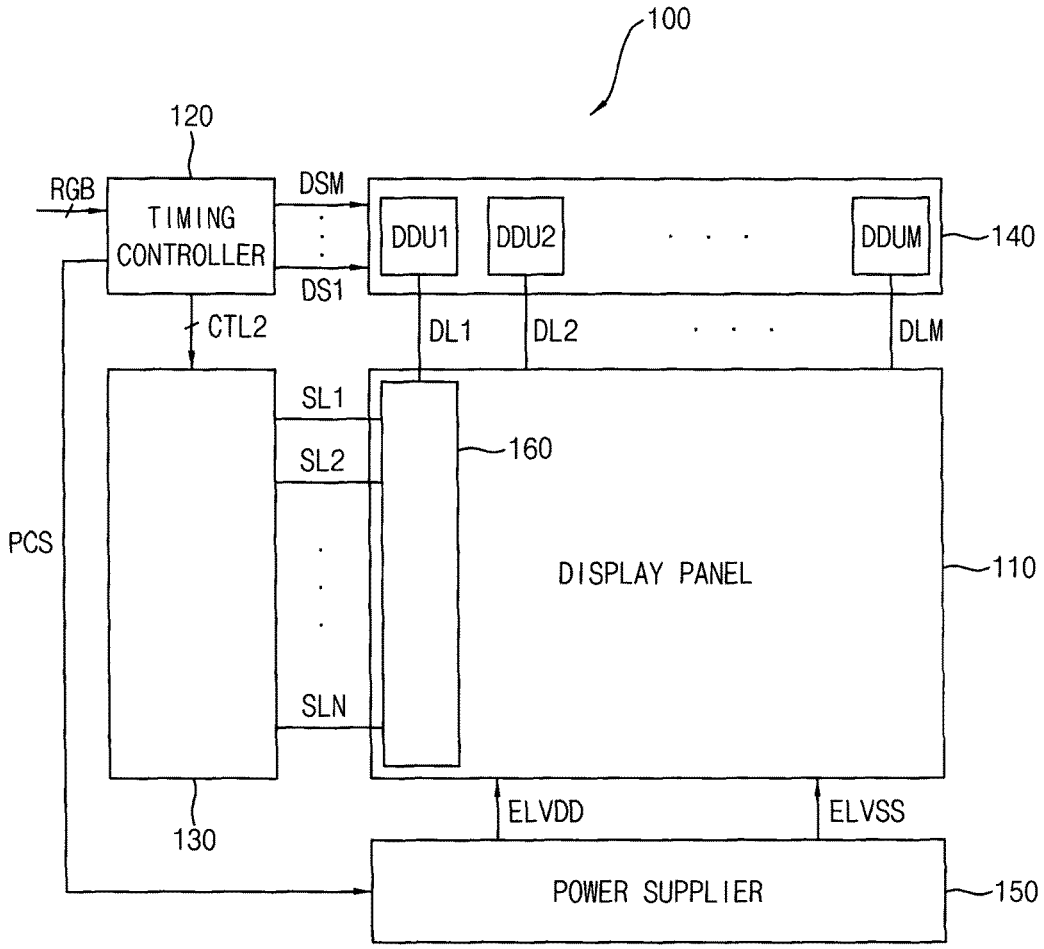
FIG. 1 is a block diagram illustrating exemplary embodiments of an OLED device according to the invention.

Hereinafter, the invention will be explained in detail with reference to the accompanying drawings.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a block diagram illustrating an organic light emitting display ("OLED") device according to exemplary embodiments.

Referring to FIG. 1, the OLED device 100 may include a display panel 110, a timing controller 120, a scan driver 130, a data driver 140 and a power supplier 150. The display panel 110 may include first pixels 160 in a first pixel column to (M)th pixels in an (M)th pixel column, where M is a positive integer. Here, the data driver 140 may include a first data driving unit DDU1 to an (M)th data driving unit DDUM.

The display panel 110 may be electrically connected to the scan driver 130 through scan lines SL1 to SLN, where N is a positive integer. The display panel 110 may be electrically connected to the data driver 140 through data lines DL1 to DLM. In an exemplary embodiment, the first pixels 160 may be electrically connected to the first data driving unit DDU1 through a first data line DL1, second pixels may be electrically connected to a second data driving unit DDU2 through a second data line DL2, and the (M)th pixels may be electrically connected to an (M)th data driving unit DDUM through an (M)th data line DLM, for example.

The first pixels 160 may include N number of pixels electrically connected to the scan lines SL1 to SLN, respectively, the second pixels may include N number of pixels electrically connected to the scan lines SL1 to SLN, respectively, and the (M)th pixels may include N number of pixels electrically connected to the scan lines SL1 to SLN, respectively. That is, the display panel 110 may include M*N number of pixels. The first pixels 160 may be explained in detail with reference to FIG. 2A The timing controller 120 may generate a scan driver control signal CTL2 to control the scan driver 130 based on the input image data RGB. The timing controller 120 may generate a first to (M)th data bits according to an input order of a data bit based on the input image data RGB, respectively, and may provide the first to (M)th data bits as a first to (M)th data signals DS1 to DSM to the data driver 140.

The timing controller 120 may generate a data signal based on grayscales (or grayscale values) of the input image data RGB. In an exemplary embodiment, the timing controller 120 may generate the data signal using a look-up table ("LUT") including the grayscales and the data signal, for example.

In exemplary embodiments, the timing controller 120 may include LUTs. The LUTs may correspond to frame structures, respectively. In an exemplary embodiment, the frame structures may include a first frame structure with 8 bits, a second frame structure with 10 bits, a third frame structure with 12 bits, and etc., for example. The LUTs may include a first LUT representing a relation between the grayscales and a data signal with 8 bits, a second LUT representing a relation between the grayscales and a data signal with 10 bits, and a third LUT representing a relation between the grayscales and a data signal with 12 bits.

In exemplary embodiments, the timing controller 120 may selectively use the LUTs. In an exemplary embodiment, the timing controller 120 may use the first LUT in a first period. In an exemplary embodiment, the timing controller 120 may use the second LUT in a second period.

In exemplary embodiments, the timing controller 120 may convert a grayscale of the input image data RGB into converted grayscales that represent a same luminance but have a different sub-frame structure. In an exemplary embodiment, the timing controller 120 may convert the grayscale of the input image data RGB into the converted grayscales by using a grayscale conversion equation, for example. A configuration of generating the converted grayscales may be explained in detail with reference to FIG. 3.

The timing controller 120 may analyze a light emission pattern of the input image data RGB. In an exemplary embodiment, the timing controller 120 may analyze a grayscale distribution of the input image data RGB. The timing controller 120 may convert the grayscale of the input image data RGB into the converted grayscale when an analyzed grayscale distribution is within a reference distribution.

The timing controller 120 may generate and provide a power control signal PCS to the power supplier 150. In an exemplary embodiment, when the timing controller 120 reduces a light emitting time of a pixel, the timing controller 120 may generate the power control signal PCS based on a reduced ratio of the light emitting time, for example. In an exemplary embodiment, the power supplier 150 may increase or decrease a level of power voltage (e.g., a high power voltage ELVDD or a low power voltage ELVSS) based on the power control signal PCS.

The scan driver 130 may provide scan signals to the display panel 110 through the scan lines SL1 to SLN based on a scan control signal CTL2.

The data driver 140 may provide the first to (M)th driving data signals to the pixels in the display panel 110 through the data lines DL1 to DLM based on the first to (M)th data signals DS1 to DSM. In an exemplary embodiment, each of the first data signal DS1 to (M)th data signal DSM is a signal with one bit, for example.

The power supplier 150 may supply the high power voltage ELVDD and the low power voltage ELVSS to the display panel 110. The power supplier 150 may control a supply level of the high power voltage ELVDD based on the power control signal PCS generated by the timing controller 120.

Figure 2A:
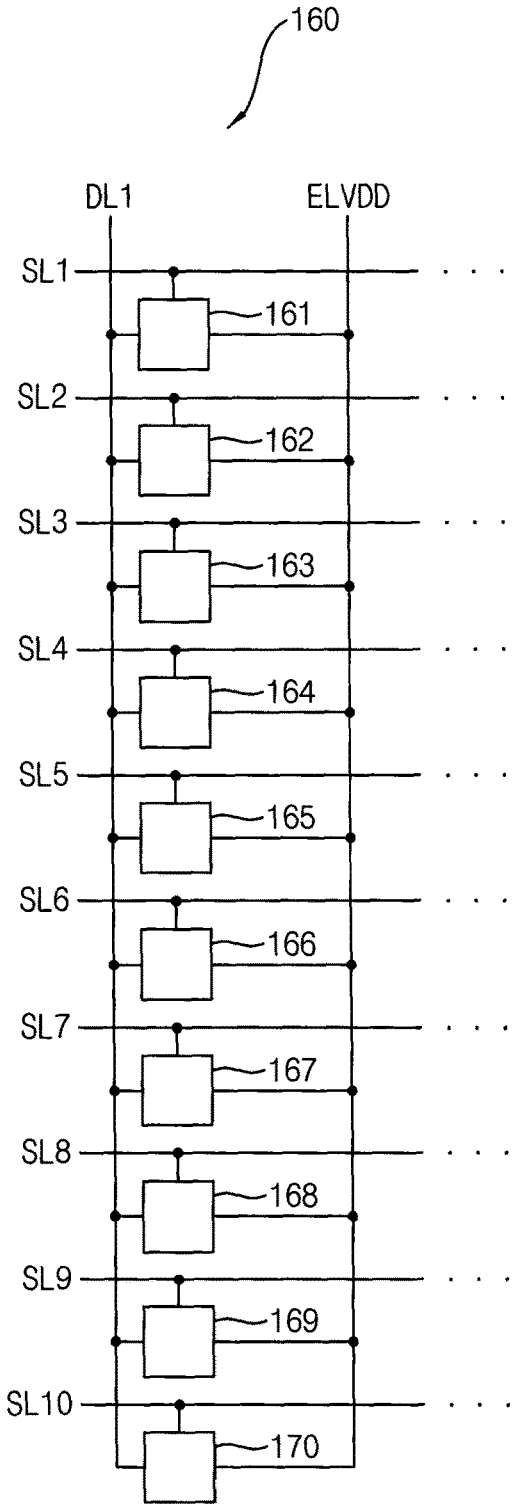
FIG. 2A is a block diagram illustrating an example of pixels included in the OLED device of FIG. 1.
Figure 2B:
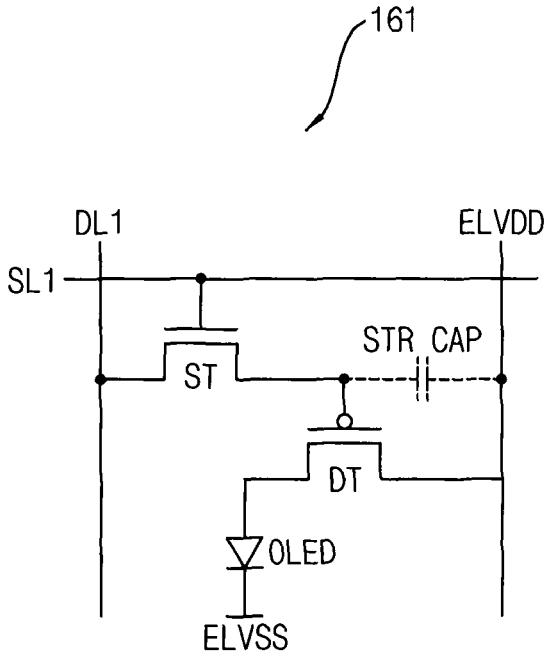
FIG. 2B is a circuit diagram illustrating an example of a first pixel included in the pixels of FIG. 2.

FIG. 2A is a block diagram illustrating an example of pixels included in the OLED device of FIG. 1, and FIG. 2B is a circuit diagram illustrating an example of a first pixel included in the pixels of FIG. 2.

Referring to FIG. 2A, the first pixels 161 to 170 may be electrically connected to the first data line DL1 when the OLED device 100 of FIG. 1 includes first to tenth scan lines SL1 to SL10, for example. The first pixels 161 to 170 may be electrically connected to the high power voltage ELVDD. The first pixel 161 may be electrically connected to the first scan line SL1. A second pixel 162 may be electrically connected to the second scan line SL2. That is, an (n)th pixel may be electrically connected to an (n)th scan line, where n is a positive integer.

Referring to FIG. 2B, the first pixel 161 may include a switching transistor ST, a driving transistor DT, an organic light emitting diode OLED, and a storage capacitor STR CAP. A source electrode of the switching transistor ST may be electrically connected to the first data line DL1. A gate electrode of the switching transistor ST may be electrically connected to the first scan line SL1. A drain electrode of the switching transistor ST may be electrically connected to one terminal of the storage capacitor STR CAP and a gate electrode of the driving transistor DT. The other terminal of the storage capacitor STR CAP may be electrically connected to the high power voltage ELVDD. A source electrode of the driving transistor DT may be electrically connected to high power voltage ELVDD. A drain electrode of the driving transistor DT may be electrically connected to one terminal of the organic light emitting diode OLED. The other terminal of the organic light emitting diode OLED may be electrically connected to the low power voltage ELVSS. A voltage greater than a threshold voltage may be supplied across the organic light emitting diode OLED, and the organic light emitting diode OLED may emit light when the switching transistor ST and the driving transistor DT are turned on based on a signal of the first data line DL1 and a signal of the first scan line SL1.

Figure 3:
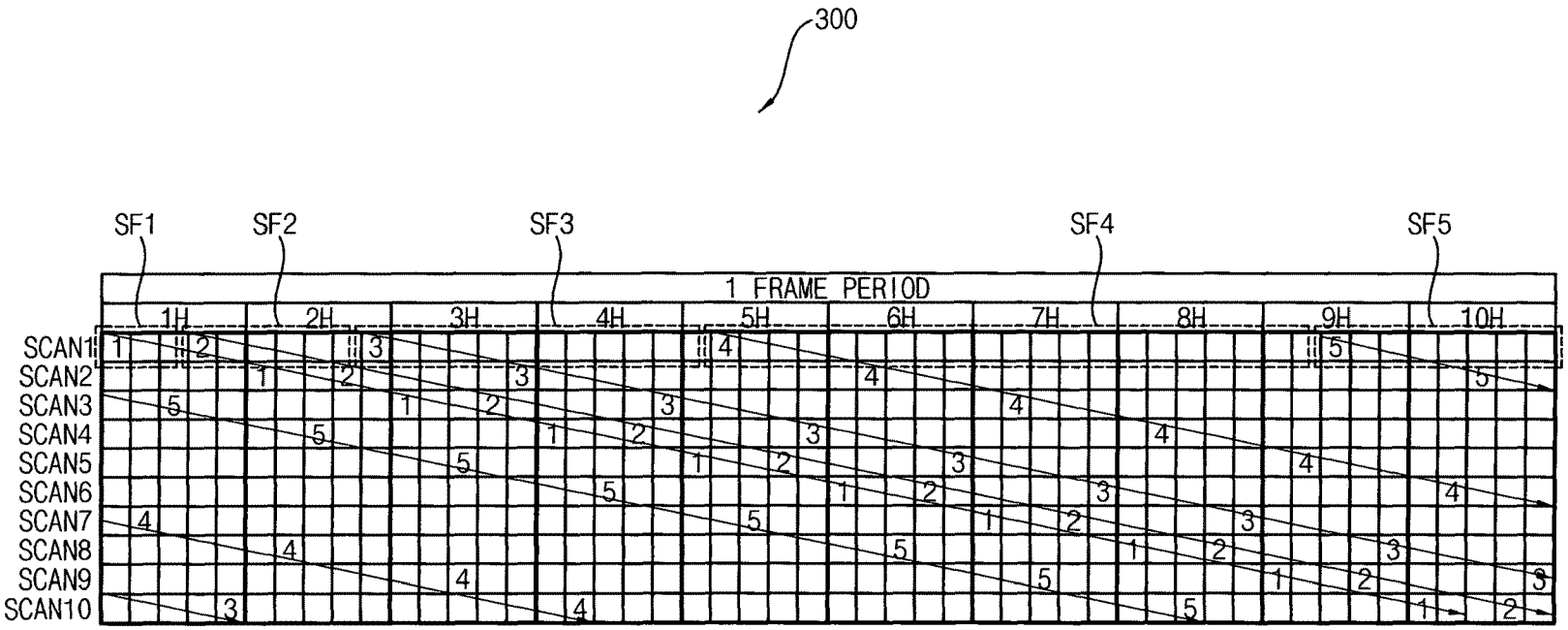
FIG. 3 is a diagram illustrating an order of data bits of sub-frames supplied to a first data driving unit included in the OLED device of FIG. 1.

FIG. 3 is a diagram illustrating an order of data bits of sub-frames supplied to a first data driving unit included in the OLED device of FIG. 1. The second to (M)th data driving units DDU2 to DDUM included in the OLED device 100 of FIG. 1 may have a configuration that is the same as or similar to a configuration of the first data driving unit DDU1, and an operation of each of the second to (M)th data driving units DDU2 to DDUM may be understood based on an operation of the first data driving unit DDU1.

Referring to FIG. 3, a frame 300 (or 1 FRAME PERIOD) may include a first to (M)th unit-display-times whose number is the same as a number of the first to (N)th scan lines SL1 to SLN included in the OLED device 100 of FIG. 1. FIG. 3 shows that the frame 300 has a five number of sub-frames, for example. In the FIG. 3, the frame 300 may include first to tenth unit-display-times 1H to 10H. Each of the first to tenth unit-display-times 1H to 10H may include five sub unit-display-times whose number is the same as a number of the sub-frames.

A grayscale of the first pixel 161 (refer to FIG. 2A) may be represented based on a sum of light emitting times of the sub-frames SF1 to SF5. The first pixel 161 may emit light based on a data of the first sub-frame SF1 at a first unit-display-time 1H. The second pixel 162 may emit light based on a data of the first sub-frame SF1 at a second unit-display-time 2H. The (n)th pixel may emit light based on a data of the first sub-frame SF1 at a (n)th unit-display-time. That is, the first to the tenth pixels 161 to 170 may emit light based on a data of the first sub-frame SF1, sequentially.

Figures 4, 5A:
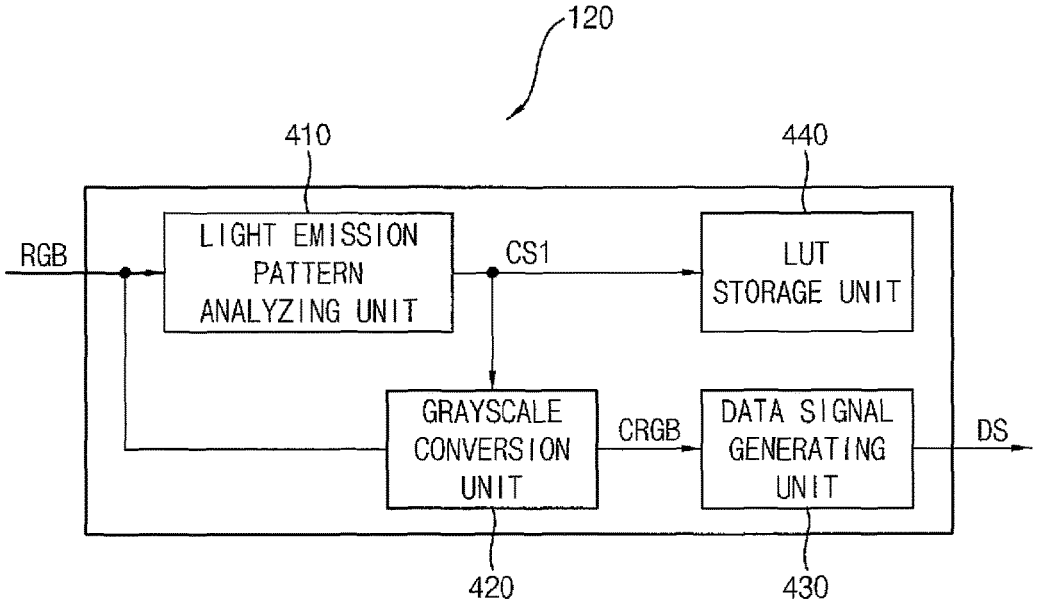

FIG. 4 is a block diagram illustrating an example of a timing controller included in the OLED device of FIG. 1.

Referring to FIG. 4, the timing controller 120 may include a light emission pattern analyzing unit 410, a grayscale conversion unit 420, a data signal generating unit 430, and an LUT storage unit 440. The light emission pattern analyzing unit 410 may analyze a light emission pattern of the input image data RGB by a frame. In an exemplary embodiment, the light emission pattern analyzing unit 410 may analyze the light emission pattern based on a grayscale distribution of the input image data RGB. In an exemplary embodiment, the light emission pattern analyzing unit 410 may generate a grayscale histogram of the input image data RGB, for example. The light emission pattern analyzing unit 410 may determine that the grayscale distribution of the emission pattern is concentrated in a certain grayscale when the grayscale distribution of the emission pattern is within a reference distribution. The light emission pattern analyzing unit 410 may generate a first control signal CS1 based on a determination result. Here, the grayscale conversion unit 420 may convert a grayscale of the input image data RGB based on the first control signal CS1.

In an exemplary embodiment, the light emission pattern analyzing unit 410 may determine that the emission pattern is concentrated when a number of pixels corresponding to a certain grayscale exceeds a reference value, for example. In an exemplary embodiment, the light emission pattern analyzing unit 410 may calculate a sum of the grayscales. The emission patter analyzing unit 410 may determine that the emission pattern is concentrated when the sum exceeds a reference value.

The grayscale conversion unit 420 may convert a third grayscale of the input image data RGB into a first converted grayscale and a second grayscale based on an analysis result of the light emission pattern of the input image data RGB. Here, the first converted grayscale and the second grayscale may correspond to luminance that is the same as luminance corresponding to the third grayscale.

In an exemplary embodiment, the grayscale conversion unit 420 may generate the first converted grayscale by reducing the third grayscale by a predetermined ratio, for example. In addition, the grayscale conversion unit 420 may generate the second converted grayscale by summing the first converted grayscale and a maximum value of the first converted grayscale. In an exemplary embodiment, the grayscale conversion unit 420 may convert the third grayscale into the first converted grayscale and the second grayscale based on a [Equation 1] below, for example.

[Equation 1]

$$Gc1=G3*k, \quad (1)$$

$$Gc2=(G3*k)+(km+1), \quad (2)$$

where Gc1 is the first converted grayscale, G3 is the third grayscale, k is an integer, Gc2 is the second converted grayscale, and km is a maximum value of the first converted grayscale.

In an exemplary embodiment, the third grayscale is 128, a predetermined ratio (i.e., the integer k) is 0.5, and the maximum value of the first converted grayscale is 127, for example. In the exemplary embodiment, the grayscale conversion unit 420 may generate the first converted grayscale having 64 and the second converted grayscale having 192, for example.

In an exemplary embodiment, the grayscale conversion unit 420 may convert the third grayscale for a first pixel (or the third grayscale corresponding to a first pixel) into the first converted grayscale and may convert the third grayscale for a second pixel (or the third grayscale corresponding to a second pixel) into the second converted grayscale. In an exemplary embodiment, the first pixel may arranged (or disposed, located) in a pixel column that is different from a pixel column in which the second pixel is arranged, or may be arranged in a pixel row that is different from a pixel row in which the second pixel is arranged.

In an exemplary embodiment, the grayscale conversion unit 420 may convert the third grayscale for the first pixel in a first pixel column into the first converted grayscale, and may convert the third grayscale for the second pixel in a second pixel column located adjacent to the first pixel column into the second converted grayscale, for example. That is, the grayscale conversion unit 420 may generate a converted grayscale by using a different grayscale conversion equation (e.g., (1) and (2) in the [Equation 1]) for each pixel column.

The grayscale conversion unit 420 may convert no grayscale of the input image data RGB when the emission pattern analyzing unit 410 determines that the light emission pattern is not concentrated in a certain grayscale. Here, the grayscale conversion unit 420 may transmit the input image data RGB to the data signal generating unit 430 without converting.

The data signal generating unit 430 may generate a data signal based on the input image data RGB or a converted input image data CRGB. Here, the converted input image data CRGB may include the first converted grayscale and the second converted grayscale.

In exemplary embodiments, the data signal generating unit 430 may generate the data signal DS by using an LUT. The LUT may include grayscales and data signals corresponding to the grayscales. The data signal generating unit 430 may output the data signal DS corresponding to a grayscale by using the LUT.

The LUT storage unit 440 may store LUTs, and may provide an LUT among the LUTs based on the first control signal CS1 generated by the emission pattern analyzing unit 410. The LUTs may be set to correspond to frame structures of image data. A configuration of the LUT may be explained in detail with reference to FIGS. 5A to 5F.

In FIG. 4, the LUT storage unit 440 is described as being separated from the data signal generating unit 430. However, the LUT storage unit 440 is not limited thereto. In an exemplary embodiment, the LUT storage unit 440 may be included in the data generating unit 430.

FIGS. 5A to 5F are diagrams illustrating examples of LUTs used in the timing controller of FIG. 4.

Referring to FIG. 5A, a first LUT 510 may include sub-frames SF1 to SF8 of 8 bits (i.e., a first frame) and a logic value of a data bit corresponding to a grayscale. The first sub-frame SF1 may include a first light emitting order and a time weight of 1. The second sub-frame SF2 may include a second light emitting order and a time weight of 2. The (n)th sub-frame may include a (n)th light emitting order and a time weight with $2^{(n-1)}$. In an exemplary embodiment, a total sum of time weights may be 255, and a maximum grayscale (or a maximum value of grayscales) may be 255.

The timing controller 120 (refer to FIG. 1) may generate a data signal of 8 bits by using the first LUT 510. In an exemplary embodiment, the timing controller 120 may generate a data signal having "11100000" corresponding to a grayscale of 7, for example. In an exemplary embodiment, the timing controller 120 may generate a data signal having "11111111" corresponding to a grayscale of 255, for example.

The pixels may emit light in a certain sub-frame intensively when the timing controller 120 uses the first LUT 510. Therefore, a drop (or a current-resistance drop) of a power voltage occurs at the certain sub-frame. The timing controller 120 may generate a data signal having only "00000001" when the input image data RGB includes only grayscales of 128, for example. Therefore, all of the pixels in the display panel 110 may not emit light during the first to the seventh frames SF1 to SF7, but may intensively emit light only during the eighth sub-frame SF8. Here, a driving current for all of the pixels to emit light may be temporarily and greatly increased, and a current-resistance drop of the power voltage may occur significantly according to an increased driving current.

Referring to FIG. 5B, the second LUT 520 may include sub-frames SF1 to SF14 of 14 bits (i.e., a second frame) and a logic value of a data bit corresponding to a grayscale. The first sub-frame SF1 may include a first light emitting order and a time weight of 64. The second sub-frame SF2 may include a second light emitting order and a time weight of 32. A third to seventh sub-frames SF3 to SF7 may include a third to seventh light emitting orders and time weight of 16, 8, 4, 2, and 1, respectively. Eighth to fourteenth sub-frames SF8 to SF14 may include eighth to fourteenth light emitting orders and time weights of 1, 2, 4, 8, 16, 32, and 64, respectively. A total sum of time weights is 254 that is smaller than a number of sub unit-display-times of 255 included in a frame.

The first to fourteenth sub-frames SF1 to SF14 may be divided into a first sub-frame group 521 and a second sub-frame group 522 based on a light emitting order and a time weight. The first sub-frame group 521 may include the first to seventh sub-frames SF1 to SF7, and the second sub-frame group 522 may include the eighth to fourteenth sub-frames SF8 to SF14. As described in FIG. 5B, the first sub-frame group 521 and the second sub-frame group 522 may include sub-frames having the same time weight.

In an exemplary embodiment, the sub-frames having the same time weight may be separated (or arranged apart) from each other. In an exemplary embodiment, the first sub-frame SF1 having a time weight of 64 may be separated from the fourteenth sub-frame SF14 having a time weight of 64. In an exemplary embodiment, the sub-frames having the same time weight may have an opposite emission time from each other. In an exemplary embodiment, the first sub-frame SF1 having a time weight of 64 may have a first light emitting order, and the fourteenth sub-frame SF14 having a time weight of 64 may have the last light emitting order. In an exemplary embodiment, the second sub-frame SF2 having a time weight of 32 may have a second light emitting order, and the thirteenth sub-frame SF13 having a time weight of 32 may have a second light emitting order from behind.

In exemplary embodiments, grayscales may be divided into a first grayscale group 526 and a second grayscale group 527 based on sub-frames used by the grayscales and a sum of time weight of the sub-frames (or luminance). In an exemplary embodiment, the first grayscale group 526 may include grayscales in a range of 0 to 127, and the second grayscale group 527 may include grayscales in a range of 128 to 255. As described in FIG. 5B, a grayscale included in the first grayscale group 526 and a grayscale included in the second grayscale group 527 may represent the same luminance. In the exemplary embodiment, both of a grayscale of 7 and a grayscale of 135 may have a time weight of 7, and pixels corresponding to the grayscale of 7 and the grayscale of 135 may emit light during a seven number of sub unit-display-times, for example. Therefore, the grayscale of 7 and the grayscale of 135 may represent the same luminance.

The light emission pattern of the pixels may be distributed when the timing controller 120 uses the second LUT 520. Therefore, a drop (or a current-resistance drop) of the power voltage described with reference to FIG. 5A may be decreased. In an exemplary embodiment, the timing controller 120 may generate a converted grayscale of 64 and a converted grayscale of 192 based on a grayscale of 128 when the input image data RGB includes grayscales of only 128, for example. That is, the timing controller 120 may generate two (or two types of) converted grayscales based on the grayscale of 128. Here, a first pixel in the display panel 110 may emit light corresponding to the converted grayscale of 64, and the second pixel in the display panel 110 may emit light corresponding to the converted grayscale of 192. That is, the first pixel and the second pixel may emit light during the first sub-frame SF1 and during the fourteenth sub-frame SF14, respectively. Therefore, a current-resistance drop of the power voltage due to a concentration of the light emission pattern may be reduced, and color deviation due to the current-resistance drop may be reduced.

Referring to FIGS. 5B and 5C, a third LUT 530 may include sub-frames SF1 to SF10 of 10 bits (i.e., a third frame) and a logic value of a data bit corresponding to a grayscale. The third LUT 530 may not include fourth to seventh sub-frames SF4 to SF7 included in the second LUT 520 of FIG. 5B. Therefore, a total sum of time weights in the third LUT 530 may be smaller than a total sum of time weights in the second LUT 520 (i.e., a total sum of time weights in the third LUT 530 may be 239).

The second grayscale group 527 (i.e., grayscales of 128 to 255) having a logic value in the fourth to seventh sub-frames SF4 to SF7 of the second LUT 520 may have the logic value in the fourth to seventh sub-frames SF4 to SF7 of the third LUT 530.

That is, the third table 530 may be similar to the second table 520. However, the fourth to the seventh sub-frames SF4 to SF7 of the third LUT 530 may be used to the first grayscale group 526 and the second grayscale group 527. Because the first grayscale group 526 and the second grayscale group 527 may use some sub-frames in common, a distributed degree (or a degree of a grayscale distribution) of the light emission pattern of the third LUT 530 may be lower than a distributed degree of the light emission pattern of the second LUT 520. However, a total sum of the time weights in the third LUT 530 may be smaller than a total sum of the time weighs in the second LUT 520. Therefore, an availability (or usability) of the third LUT 530 may be improved. The availability of an LUT may be explained in detail with reference to FIG. 5F.

Referring to FIGS. 5B and 5D, the fourth LUT 540 may include sub-frames SF1 to SF14 of 14 bits (i.e., a fourth frame) and a logic value of a data bit corresponding to a grayscale. The first to the seventh sub-frames SF1 to SF7 of the fourth LUT 540 may have time weights arranged in reverse order of time weights in the first to seventh sub-frames SF1 to SF7 of the second LUT 520. In the fourth LUT 540, the first to seventh sub-frames SF1 to SF7 may have a first to seventh light emitting orders and time weights of 1, 2, 4, 8, 16, 32, and 64, sequentially. The eighth to fourteenth sub-frames SF8 to SF14 of the fourth LUT 540 may be the same as or similar to the eighth to fourteenth sub-frames SF8 to SF14 of the second LUT 520. A total sum of time weights of the first to fourteenth sub-frames SF1 to SF1 in the fourth LUT 540 may be 254.

In the fourth LUT 540, sub-frames having the same time weight may be separated from each other. In an exemplary embodiment, the seventh sub-frame SF7 having a time weight of 64 may have a seventh light emitting order in the first sub-frame group 526, and the fourteenth sub-frame SF14 having a time weight of 64 may have a seventh light emitting order in the second sub-frame group 522. In an exemplary embodiment, the sixth sub-frame SF6 having a time weight of 32 may have a sixth light emitting order in the first sub-frame group 526, and the thirteenth sub-frame SF13 having a time weight of 32 may have a sixth 2*o*-light emitting order in the second sub-frame group 522. That is, the sub-frames having the same time weight may be separated with a certain distance in a frame.

The light emission pattern of the pixels may be distributed when the timing controller 120 uses the fourth LUT 540. Therefore, a drop (or a current-resistance drop) of the power voltage described with reference to FIG. 5A may be decreased. In an exemplary embodiment, the timing controller 120 (refer to FIG. 1) may generate a converted grayscale of 64 and a converted grayscale of 192 based on a grayscale of 128 when the input image data RGB includes grayscales of only 128. That is, the timing controller 120 may generate two converted grayscales based on the grayscale of 128. Here, a first pixel in the display panel 110 may emit light corresponding to the converted grayscale of 64, and the second pixel in the display panel 110 may emit light corresponding to the converted grayscale of 192. That is, the first pixel and the second pixel may emit light during the seventh sub-frame SF7 and during the fourteenth sub-frame SF14, respectively. Therefore, a current-resistance drop of the power voltage due to a concentration of the light emission pattern may be reduced, and color deviation due to the current-resistance drop may be reduced.

Referring to FIGS. 5D and 5E, a fifth LUT 550 may include sub-frames SF1 to SF12 of 12 bits (i.e., a fifth frame) and a logic value of a data bit corresponding to a grayscale. The fifth LUT 550 may not include an eighth sub-frame SF8 and a ninth sub-frame SF9 included in the fourth LUT 540 of FIG. 5D. Therefore, a total sum of time weights in the fifth LUT 550 may be smaller than a total sum of time weights in the fourth LUT 540 (i.e., a total sum of time weights in the fifth LUT 550 may be 251).

The second grayscale group 526 (i.e., grayscales in a range of 0 to 127) having a logic value in the eighth sub-frame SF8 and the ninth sub-frame SF9 of the fourth LUT 540 may have the logic value in the first sub-frame SF1 and the second sub-frame SF2 of the fifth LUT 550.

That is, the fifth LUT 550 may be similar to the fourth LUT 540. However, the first sub-frame SF1 and the second sub-frame SF2 of the fifth LUT 550 may be used to the first grayscale group 526 and the second grayscale group 527. Because the first grayscale group 526 and the second grayscale group 527 may use some sub-frames (e.g., SF2 to SF8) in common, a distributed degree (or a degree of a grayscale distribution) of the light emission pattern of the fifth LUT 550 may be lower than a distributed degree of the light emission pattern of the fourth LUT 540. However, a total sum of the time weights in the fifth LUT 550 may be smaller than a total sum of the time weighs in the fourth LUT 540. Therefore, an availability of the fifth LUT 550 may be improved. The availability of an LUT may be explained in detail with reference to FIG. 5F.

Referring to FIG. 5F, the sixth LUT 560 may include sub-frames SF1 to SF9 of 9 bits (i.e., a sixth frame) and a logic value of a data bit corresponding to a grayscale. The first sub-frame SF1 may include a first light emitting order and a time weight of 128. The second sub-frame SF2 may include a second light emitting order and a time weight of 1. An (m)th sub-frame may include an (m)th light emitting order and a time weight of $2^{(m-2)}$, where, m is greater than 2. A total sum of time weights may be 383. The OLED device 100 may use the sixth LUT 560 when a maximum grayscale (or a maximum value of a grayscale) of the input image data RGB is 256 and when the OLED device 100 divides a frame into 383 or more number of sub unit-display-times. In an exemplary embodiment, when the OLED device 100 divides a frame into 256 or more and 512 or less number of sub unit-display-times, the OLED device 100 may include a sub-frame (e.g., a first sub-frame SF1 or a ninth sub-frame SF9) having a time weight whose size is the same as a size of a rest sub unit-display-times that exceeds 256 (e.g., 383−255=128).

Therefore, the OLED device 100 may distribute the light emission pattern of pixels without reduction of color expression capability by using the sixth LUT 560. When the sixth LUT 560 (i.e., an eighth LUT) further including a tenth sub-frame having a time weight of 64 (i.e., a time weight of the eighth sub-frame SF8) is referred to as an eighth LUT (not shown), the eighth LUT may improve a distributed degree of the light emission pattern than the sixth LUT 560. However, the eight LUT may be used by only the OLED device 100 capable of dividing a frame into 447 (i.e., 383+64) or more number of sub unit-display-times. Therefore, the sixth LUT 560 may be more widely used than the eighth LUT.

The sixth LUT 560 may include grayscales in a range of 263 to 383 (i.e., a second grayscale group 527). A total sum of time weights of the grayscales in a range of 263 to 383 may be in a range of 135 to 255. That is, the grayscales in a range of 263 to 383 may represent luminance that is the same as luminance of grayscales in a range of 135 to 255 (i.e., a first grayscale group 526). The grayscales in a range of 135 to 255 may have a logic value of 1 in the ninth sub-frame SF9, but the grayscales in a range of 263 to 383 may have a logic value of 1 in the first sub-frame SF1. Therefore, the light emission pattern of the pixels may be distributed when the timing controller 120 uses the sixth LUT 560, and a drop (or a current-resistance drop) of the power voltage described with reference to FIG. 5A may be decreased.

Figure 6:
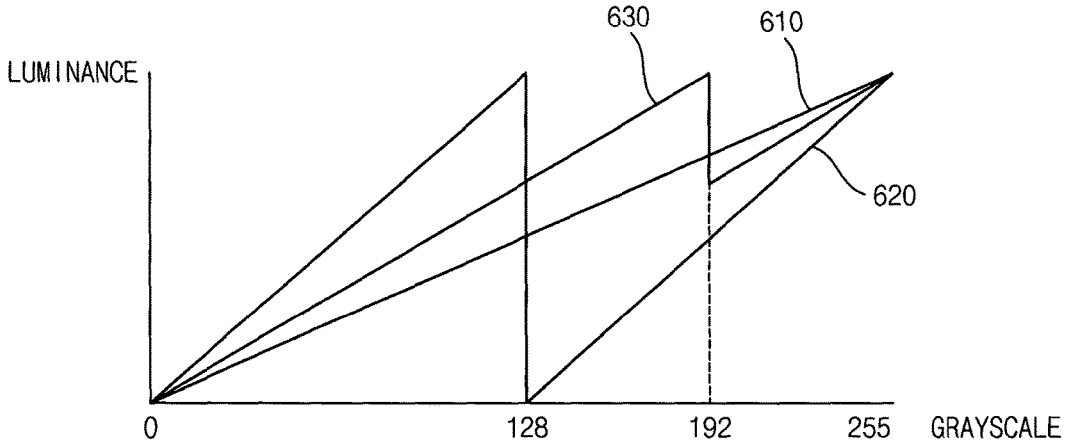
FIG. 6 is a diagram illustrating a relation between luminance and a converted grayscale generated by the timing controller of FIG. 4.

FIG. 6 is a diagram illustrating a relation between luminance and a converted grayscale generated by the timing controller of FIG. 4.

Referring to FIG. 6, a first graph 610 may represent luminance corresponding to grayscales included in the first LUT 510 described in FIG. 5A. That is, each of the grayscales may represent a different luminance in the first graph 610.

A second graph 620 may represent luminance corresponding to grayscales included in the fourth LUT 540 described in FIG. 5D. That is, grayscales in a range of 0 to 127 may represent luminance that is the same as luminance of grayscales in a range of 128 to 255 in the second graph 620.

Grayscales in a range of 128 to 191 may represent luminance that is the same as luminance of grayscales in a range of 192 to 255 in a third graph 630. That is, some grayscales among all of grayscales may represent a same luminance. In an exemplary embodiment, a color deviation between pixels may be easily viewed in a high luminance area than in a low luminance area. Here, the timing controller 120 may generate grayscales having the same luminance only in the high luminance area.

Figure 7:
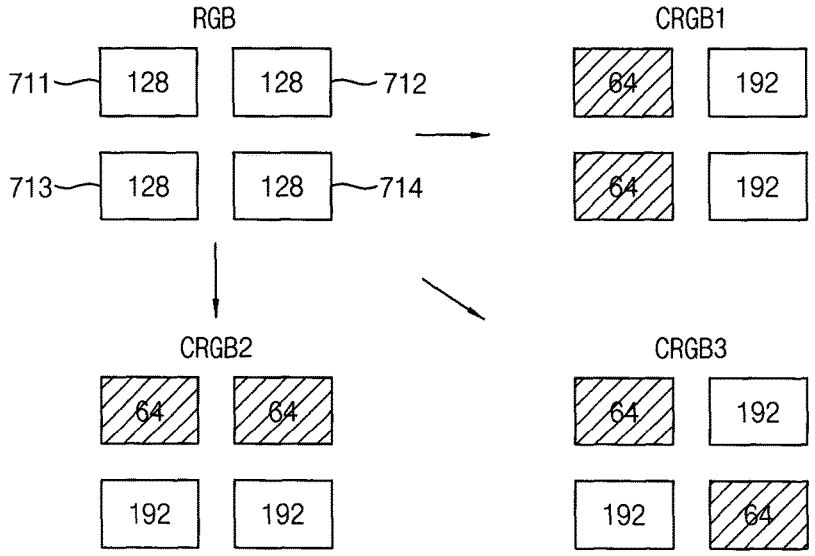
FIG. 7 is a diagram illustrating a mapping result of grayscales in the OLED device of FIG. 1.

FIG. 7 is a diagram illustrating a mapping result of grayscales in the OLED device of FIG. 1.

Referring to FIG. 7, first to fourth pixels 711 to 714 may have (or correspond to) grayscales of 128 according to the input image data RGB.

In an exemplary embodiment, the timing controller 120 may convert a grayscale of the first pixel 711 and a grayscale of the third pixel 713 into a first converted grayscale of 64 by using the third LUT 530 described in FIG. 5C. Similarly, the timing controller 120 may convert a grayscale of the second pixel 712 and a grayscale of the fourth pixel 714 into a second converted grayscale of 192. That is, the first pixel 711 and the third pixel 713 may have grayscales of 64, and the second pixel 712 and the fourth pixel 714 may have grayscales of 192 in a first converted input image data CRGB1. The timing controller 120 may generate a first data signal having "1000000000" based on the grayscales of 64, and may generate a second data signal having "0000000001" based on the grayscales of 192. The first pixel 711 and the third pixel 713 may emit light in the first sub-frame SF1, and the second pixel 712 and the fourth pixel 714 may emit light in the first tenth-frame SF10. Therefore, pixel columns may emit light in a different sub-frame.

In an exemplary embodiment, the timing controller 120 may convert a grayscale of the first pixel 711 and a grayscale of the second pixel 712 into the first converted grayscale of 64 by using the third LUT 530 described in FIG. 5C. Similarly, the timing controller 120 may convert a grayscale of the third pixel 713 and a grayscale of the fourth pixel 714 into the second converted grayscale of 192. Therefore, pixel rows may emit light in a different sub-frame.

In an exemplary embodiment, the timing controller 120 may convert a grayscale of the first pixel 711 and a grayscale of the fourth pixel 714 into the first converted grayscale of 64 by using the third LUT 530 described in FIG. 5C. Similarly, the timing controller 120 may convert a grayscale of the second pixel 712 and a grayscale of the third pixel 713 into the second converted grayscale of 192. Therefore, all of pixels may emit light in a grid.

Figure 8:
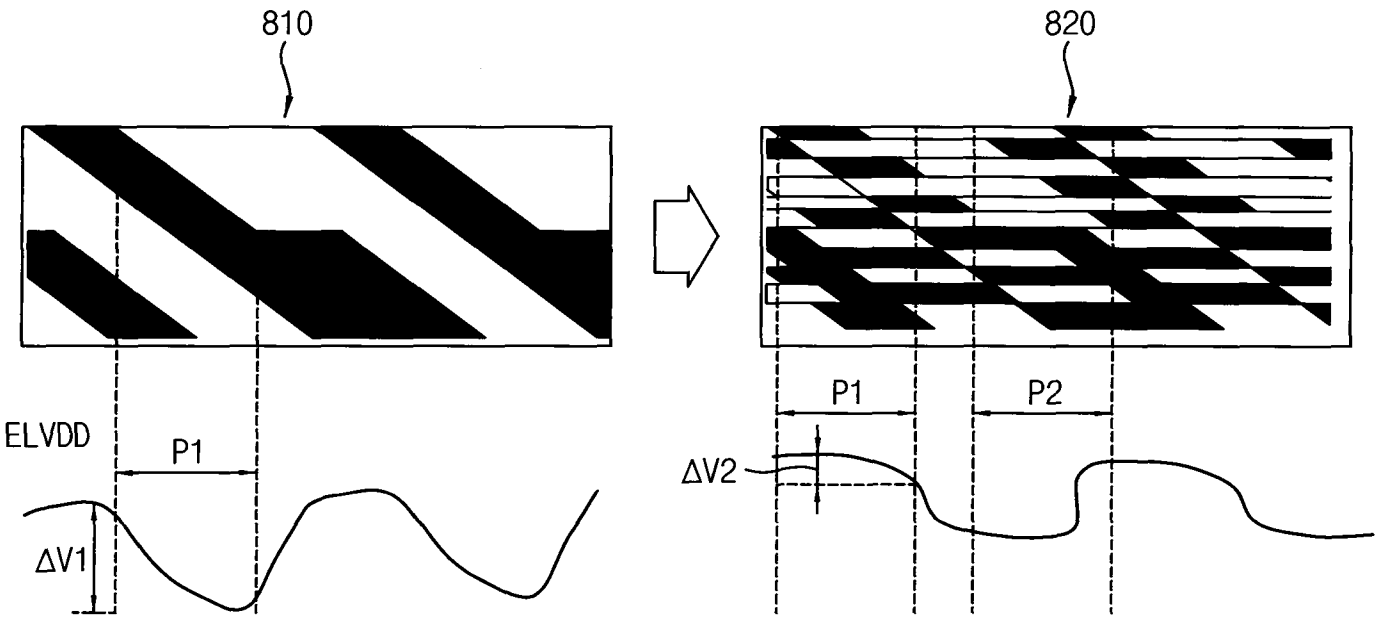
FIG. 8 is a diagram illustrating a change of a driving power voltage of the OLED device of FIG. 1.

FIG. 8 is a diagram illustrating a change of a driving power voltage of the OLED device of FIG. 1.

Referring to FIGS. 4 and 8, in a first emission diagram 810 of a conventional OLED device, pixels may intensively emit light in a first period P1 corresponding to a certain grayscale, and the high power voltage ELVDD may have a first current-resistance drop AV1. Because the pixels may emit light differently according to a change of the high power voltage, a color deviation between the pixels may occur.

In a second emission diagram 820 of the OLED device 100 according to exemplary embodiments, the pixels may emit light in the first period P1 and a second period P2 corresponding to the certain grayscale, and the high power voltage ELVDD may have a second current-resistance drop AV2. Because the second current-resistance drop AV2 of the high power voltage ELVDD may be less and more gradual than the first current-resistance drop AV1, the color deviation between the pixels may be reduced.

Figure 9:
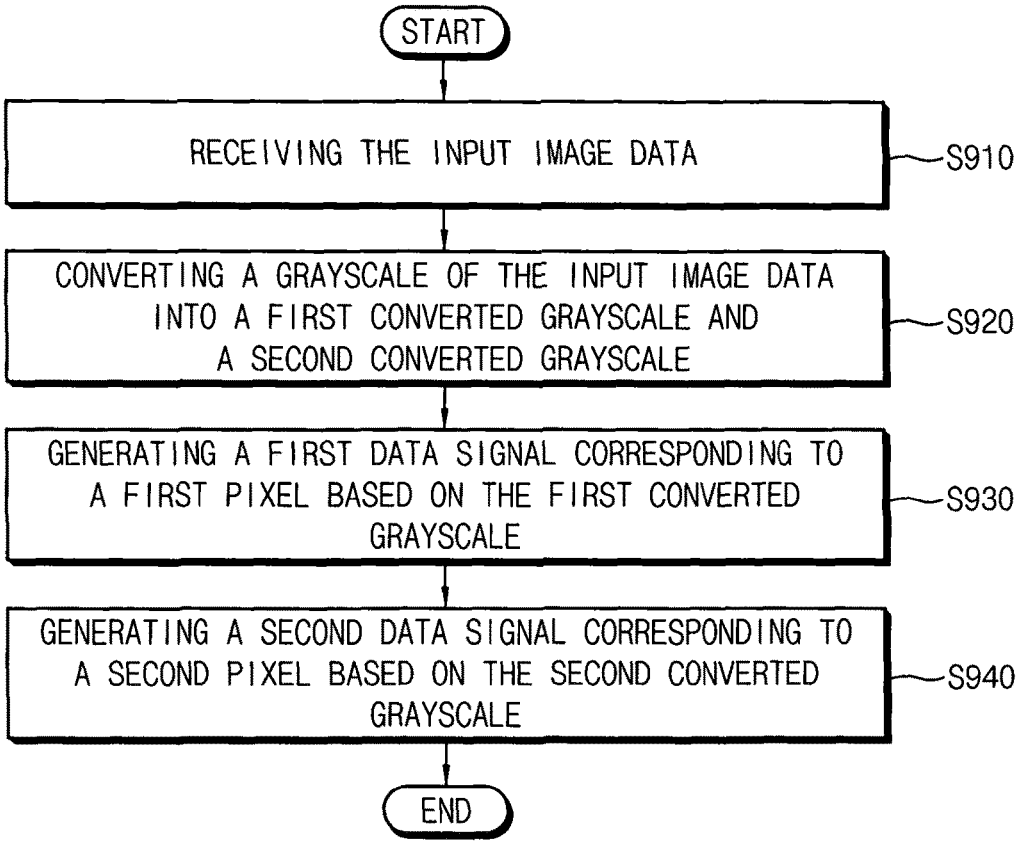
FIG. 9 is a flowchart illustrating exemplary embodiments of a method of digital-driving an OLED device according to the invention.

FIG. 9 is a flowchart illustrating a method of digital-driving an OLED device according to exemplary embodiments.

Referring to FIGS. 1 and 9, the method of FIG. 9 may receive the input image data RGB (S910). The method of FIG. 9 may convert a grayscale of the input image data RGB into a first converted grayscale and a second converted grayscale (S920). That is, the method of FIG. 9 may generate a converted input image data CRGB by converting the input image data RGB. As described with reference to FIG. 3, the method of FIG. 9 may generate the first converted grayscale and the second converted grayscale by using the [Equation 1]. The first converted grayscale and the second converted grayscale may represent a same luminance. However, the first converted grayscale and the second converted grayscale may have a different sub-frame structure as described with reference to FIGS. 5B to 5F.

The method of FIG. 9 may generate data signals corresponding to the pixels based on the converted input image data CRGB. In an exemplary embodiment, the method of FIG. 9 may generate a first data signal corresponding to the first pixel based on the first converted grayscale (S930), and the method of FIG. 9 may generate a second data signal corresponding to the second pixel based on the second converted grayscale (S940), for example.

As described above, the method of digital-driving the OLED device 100 may generate grayscales (or converted grayscales) representing a same luminance, and may map (or associate, correspond) the grayscales having the same luminance but a different sub-frame structure to the first pixel and the second pixel, respectively. Therefore, the method may distribute a light emission pattern of the input image data RGB.

Figure 10:
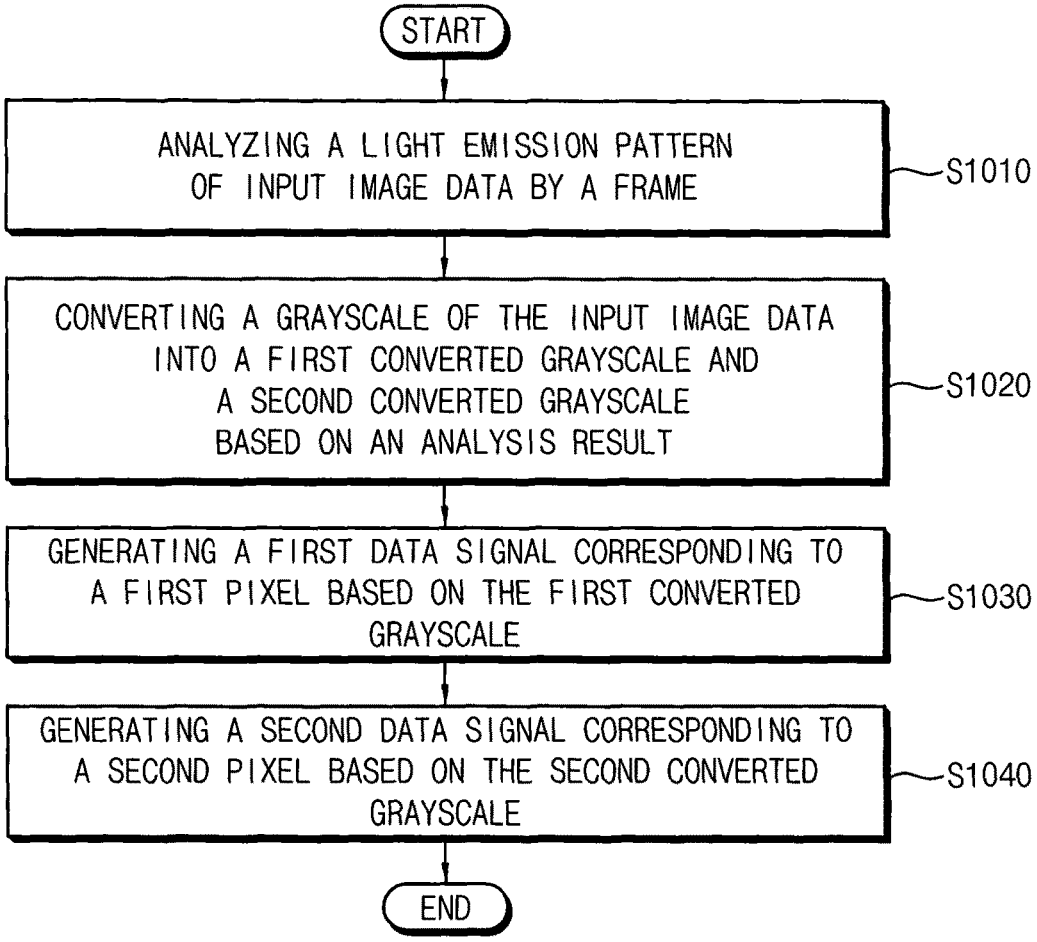
FIG. 10 is a flowchart illustrating exemplary embodiments of a method of digital-driving an OLED device according to the invention.

FIG. 10 is a flowchart illustrating a method of digital-driving an OLED device according to exemplary embodiments.

Referring to FIG. 10, the method may analyze a light emission pattern of the input image data RGB by a frame (S1010). A configuration of analyzing the light emission pattern is explained with reference to FIG. 3. Thus, duplicated description will not be repeated.

The method of FIG. 10 may convert a grayscale (e.g., a third grayscale) of the input image data RGB into the first converted grayscale and the second converted grayscale based on an analysis result of the light emission pattern of the input image data RGB (S1020). That is, the method of FIG. 10 may generate a converted input image data CRGB by converting the input image data RGB. As described with reference to FIG. 3, the method of FIG. 10 may generate the first converted grayscale and the second converted grayscale by using the [Equation 1]. The first converted grayscale and the second converted grayscale may represent a same luminance. However, the first converted grayscale and the second converted grayscale may have a different sub-frame structure as described with reference to FIGS. 5B to 5F.

The method of FIG. 10 may generate data signals corresponding to the pixels based on the converted input image data CRGB. In an exemplary embodiment, the method of FIG. 10 may generate a first data signal corresponding to the first pixel based on the first converted grayscale (S1030), and the method of FIG. 10 may generate a second data signal corresponding to the second pixel based on the second converted grayscale (S1040).

As described above, the method of digital-driving the OLED device 100 may analyze the light emission pattern, may generate grayscales having the same luminance when the light emission pattern is determined to concentrate in a certain grayscale, and may map (or associate, correspond) the grayscales having the same luminance but a different sub-frame structure to the first pixel and the second pixel, respectively. Therefore, the method may distribute a light emission pattern of the input image data RGB, and may reduce a current-resistance drop of the input image data RGB. In addition, a color deviation between the pixels may be reduced.

A frame structure of image data used in a digital-driving an OLED device, the frame structure of the image data may include a first sub-frame having a first light emitting order and a first time weight and a second sub-frame having the first time weight and a second light emitting order separated from the first light emitting order. Here, the first sub-frame may be used to display a first grayscale, the second sub-frame may be used to display a second grayscale, and the first grayscale and the second grayscale may correspond to a same luminance.

The frame structure of an image may include a third sub-frame having a third light emitting order and a third time weight, where the third sub-frame may be used to display the first grayscale and the second grayscale. Here, the second light emitting order is opposite to the first light emitting order in a frame of the image data.

The frame structure of an image is described with reference LUT described in FIG. 5A to 5F. Thus, duplicated description will not be repeated.

The invention may be applied to any display device (e.g., an OLED device, a liquid crystal display device, etc.) including a gate driver. In an exemplary embodiment, the invention may be applied to a television, a computer monitor, a laptop, a digital camera, a cellular phone, a smart phone, a personal digital assistant ("PDA"), a portable multimedia player ("PMP"), an MP3 player, a navigation system, a video phone, etc.

The foregoing is illustrative of exemplary embodiments, and is not to be construed as limiting thereof. Although a few exemplary embodiments have been described, those skilled in the art will readily appreciate that many modifications are possible in the exemplary embodiments without materially departing from the novel teachings and advantages of exemplary embodiments. Accordingly, all such modifications are intended to be included within the scope of exemplary embodiments as defined in the claims. In the claims, means-plus-function clauses are intended to cover the structures described herein as performing the recited function and not only structural equivalents but also equivalent structures. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of digital-driving an organic light emitting display device which displays an image based on input image data by dividing a frame into sub-frames, the method comprising:

analyzing a light emission pattern of the input image data for each frame; and converting a third grayscale of the input image data from the organic light emitting display device into a first converted grayscale and a second converted grayscale based on an analysis result of the light emission pattern of the input image data, wherein the converting the third grayscale of the input image data includes:

converting the third grayscale of the input image data for a first pixel into the first converted grayscale which uses a first sub-frame; and converting the third grayscale of the input image data for a second pixel located adjacent to the first pixel into the second converted grayscale which uses a second sub-frame, wherein each of the first sub-frame and the second sub-frame has a first time weight, and wherein luminance implemented by the first pixel based on the first converted grayscale is the same as luminance implemented by the second pixel based on the second converted grayscale.

2. The method of claim 1, wherein the frame includes a first sub-frame group and a second sub-frame group which are divided based on light emitting orders of the sub-frames, wherein the first sub-frame group includes the first sub-frame, and wherein the second sub-frame group includes the second sub-frame.

3. The method of claim 1, wherein the first sub-frame is spaced apart from the second sub-frame in the frame.

4. The method of claim 1, wherein the first sub-frame has a light emitting order opposite to a light emitting order of the second sub-frame.

5. The method of claim 1, wherein the first time weight is the largest among a plurality of time weights included in the frame.

6. The method of claim 1, wherein the converting the third grayscale of the first pixel into the first converted grayscale includes:

reducing the third grayscale by a predetermined ratio.

7. The method of claim 6, further comprising:

increasing a driving power voltage supplied to a display panel in proportion to the predetermined ratio.

8. The method of claim 1, wherein the converting the third grayscale of the second pixel into the second converted grayscale includes:

generating the second converted grayscale by summing the first converted grayscale and a maximum value of the first converted grayscale.

9. The method of claim 1, wherein the first pixel is located in a pixel column which is different from a pixel column including the second pixel.

10. The method of claim 1, wherein the first pixel is located in a pixel row which is different from a pixel row including the second pixel.

11. The method of claim 1, wherein the analyzing the light emission pattern of the input image data includes:

analyzing a grayscale distribution of the input image data.

12. The method of claim 11, wherein the third grayscale of the input image data is converted into the first converted grayscale and the second converted grayscale when the grayscale distribution of the input image data is within a reference distribution.

13. The method of claim 1, further comprising:

generating a data signal from the input image data based on the first converted grayscale and the second converted grayscale.

14. A method of digital-driving an organic light emitting display device which displays an image based on input image data by dividing a frame into sub-frames, the method comprises:

receiving the input image data; and converting a third grayscale of the input image data from the organic light emitting display device into a first converted grayscale and a second converted grayscale based on an analysis result of a light emission pattern of the input image data, wherein the converting the third grayscale of the input image data includes:

converting the third grayscale of the input image data for a first pixel into the first converted grayscale which uses a first sub-frame; and converting the third grayscale of a second pixel located adjacent to the first pixel into the second converted grayscale which uses a second sub-frame, wherein each of the first sub-frame and the second sub-frame has a first time weight, and wherein luminance implemented by the first pixel based on the first converted grayscale is the same as luminance implemented by the second pixel based on the second converted grayscale.

15. The method of claim 14, wherein the first sub-frame has a light emitting order opposite to a light emitting order of the second sub-frame.

* * * * *